US009284680B2

(12) United States Patent
Uchikoshi

(10) Patent No.: US 9,284,680 B2
(45) Date of Patent: Mar. 15, 2016

(54) SHIRTS PRESS FINISHING MACHINE AND SHEET MATERIAL FOR USED SHIRTS PRESS FINISHING MACHINE

(75) Inventor: Mitsuyuki Uchikoshi, Tokyo (JP)

(73) Assignee: Sankousha Engineering Co., Ltd., Tokyo (JP)

( * ) Notice: Subject to any disclaimer, the term of this patent is extended or adjusted under 35 U.S.C. 154(b) by 275 days.

(21) Appl. No.: 13/176,339

(22) Filed: Jul. 5, 2011

(65) Prior Publication Data

US 2012/0006862 A1 Jan. 12, 2012

(30) Foreign Application Priority Data

Jul. 8, 2010 (JP) ..... 2010-155936

(51) Int. Cl.
*D06F 73/00* (2006.01)
*D06F 71/20* (2006.01)

(52) U.S. Cl.
CPC ..... *D06F 73/00* (2013.01); *D06F 71/20* (2013.01)

(58) Field of Classification Search
CPC ... A41H 5/02; D06F 7171/16; D06F 7171/18; D06F 71/22; D06F 71/323; D06F 83/00
USPC ..... 223/57, 66, 67, 68, 70, 73, 72, 74; 38/84, 85, 14
See application file for complete search history.

(56) References Cited

U.S. PATENT DOCUMENTS

| | | | | |
|---|---|---|---|---|
| 3,595,450 | A * | 7/1971 | Schlemon et al. | 223/57 |
| 5,148,955 | A * | 9/1992 | Cares | 223/70 |
| 6,237,261 | B1 * | 5/2001 | Hickle et al. | 38/7 |
| 6,662,980 | B1 * | 12/2003 | Hickle et al. | 223/57 |
| 6,840,412 | B2 * | 1/2005 | Damrath et al. | 223/57 |
| 6,868,996 | B1 | 3/2005 | Uchikoshi | |
| 6,913,172 | B2 * | 7/2005 | Damrath et al. | 223/67 |
| 2003/0226863 | A1 * | 12/2003 | Hickle et al. | 223/57 |
| 2004/0222250 | A1 * | 11/2004 | Redlin | 223/67 |
| 2005/0067442 | A1 * | 3/2005 | Redlin | 223/70 |
| 2012/0006862 | A1 * | 1/2012 | Uchikoshi | 223/57 |

* cited by examiner

*Primary Examiner* — Shaun R Hurley
*Assistant Examiner* — Andrew W Sutton
(74) *Attorney, Agent, or Firm* — Andrus Intellectual Property Law, LLP

(57) ABSTRACT

A shirt press finishing machine has a torso for carrying a shirt and a pair of front part and rear part side press irons. Iron receiving surfaces of the front and rear parts of the torso are covered with cushioning sheet materials and long and thin bags expanded by gas are attached to both sides of the front and rear sheet materials over substantially the entire longitudinal length of the sheet materials.

3 Claims, 7 Drawing Sheets

SHIRTS PRESS FINISHING MACHINE AND SHEET MATERIAL FOR USED SHIRTS PRESS FINISHING MACHINE

BACKGROUND OF INVENTION (1) Field of the Invention

This invention relates to a shirts press finishing machine of a type in which a shirt such as a white shirt of laundry is put on the torso of the machine and finished while being pressed with press irons, and more particularly, the shirts press finishing machine adapted to enable the side parts of the shirts to be finished neatly and to a sheet material for use on the shirts press finishing machine.

(2) Description of the Related Art

With this type of prior art press machine, there has been already disclosed a system described in U.S. Pat. No. 6,868,996, for example. This prior art machine is formed such that the devices for pulling out the side parts of the shirts and applying tension to them are installed on both side parts of the torso.

In addition, with this type of prior art press machine, there has been already disclosed a system formed in such a way that the side bags are installed at both side parts of the torso and the side parts of the shirts are finished in tension by the side bags (refer to U.S. Pat. No. 6,840,412, for example).

To the contrary, this type of prior art press machine has shown sometimes a situation in which upon pressing the shirts with a pair of a front part side press iron and a rear part side press iron, as the case may be, lines at both ends of the torso from some iron marks on the shirts.

Accordingly, it is preferable for this type of press machine to be formed in such a way that the side parts of the shirts can be finished neatly without applying any such iron marks at the shirts.

To the contrary, the prior art press machine described in each of the above cited References has a structure in which the side parts of the shirts are tensioned to remove some wrinkles formed at the side parts of the shirts. However, some of these prior art machines merely enabled the wrinkles at the side parts of the shirts to be removed and could not prevent the lines at both ends of the torso from being left on the shirts as iron marks.

SUMMARY OF INVENTION

This invention has been proposed in view of the aforesaid problems found in the prior art.

Accordingly, the technical problem to be solved by this invention is to provide a shirts press finishing machine capable of preventing the lines at both ends of the torso from being left on the shirts as iron marks and further capable of finishing the side parts of the shirts neatly with the press irons, and to provide a sheet material for use on the shirts press finishing machine.

In order to solve the aforesaid problems, this invention employs the technical means described as follows.

That is, as shown in FIG. 1 and other Figures, the shirts press finishing machine of this invention is formed to have a torso is put a shirts on and a pair of front part side press iron and rear part side press iron for use press finishing of the shirts while pressing the front and rear parts of the torso. Then, the shirts press finishing machine of this invention is constituted such that iron receiving surfaces of the front and rear parts of the torso are covered with cushion-type sheet materials and long and thin bags expanded by supplying gas are attached to both sides of the front and rear sheet materials over the substantial entire longitudinal length of the sheet materials (Claim 1).

The sheet material is practically formed such as felt, flannelette, sponge and rubber etc. Since the sheet material has a cushion characteristic, it has a function for causing the press irons to be adapted for the torso when the torso is pressed by press irons. In addition, the bags are made of non-porous cloth and formed to have lateral width under flat state, for example, of about 8 (cm) In addition, in this case, the substantial entire longitudinal length of the sheet material is meant by a range of a longitudinal where a press pressure is applied. More practically, this length is realized with the same length as the longitudinal length of the sheet materials covered the iron receiving surfaces of the front and rear parts of the torso or with a length of little bit shorter than the former length.

As a method for attaching the bags, it can be performed with a sewing operation or an adhering operation and the like, for example. In this case, it may also be applicable that the bags can remove and attach to the sheet material because this method enables only the sheet materials to be replaced with a new one when a cushion characteristic of the sheet material is reduced, and further enables its cost to be reduced.

In addition, as the cushion-type sheet material for used the shirt press finishing machine of this invention, one illustrated in FIG. 4 or the like can be applied.

That is, the sheet material of this invention is made such that the long and thin bags expanded by supplying gas are attached to both side portions of sheet materials over a substantial entire longitudinal length (Claim 7).

The shirts press finishing machine of this invention and the sheet material for used it are formed like described above.

Accordingly, in the case of this invention, the bags push the side parts of the shirts against the iron surfaces of the press irons when the bags are expanded. Accordingly, this invention can be prevented to the lines at both ends of the torso from being left in the shirts as the iron marks with the bags being applied as cushions. As a result, in accordance with this invention, it is possible to press finishing of the side parts of the shirts neatly.

BRIEF DESCRIPTION OF DRAWINGS

FIG. 10 is an essential front view showing the shirt stretch out device for the side parts in.

DESCRIPTION OF PREFERRED EMBODIMENT

Referring now to the accompanying drawings, one preferred embodiment of the shirts press finishing machine of this invention and the sheet material for use in the shirts press finishing machine will be described as follows.

Figure 1A:
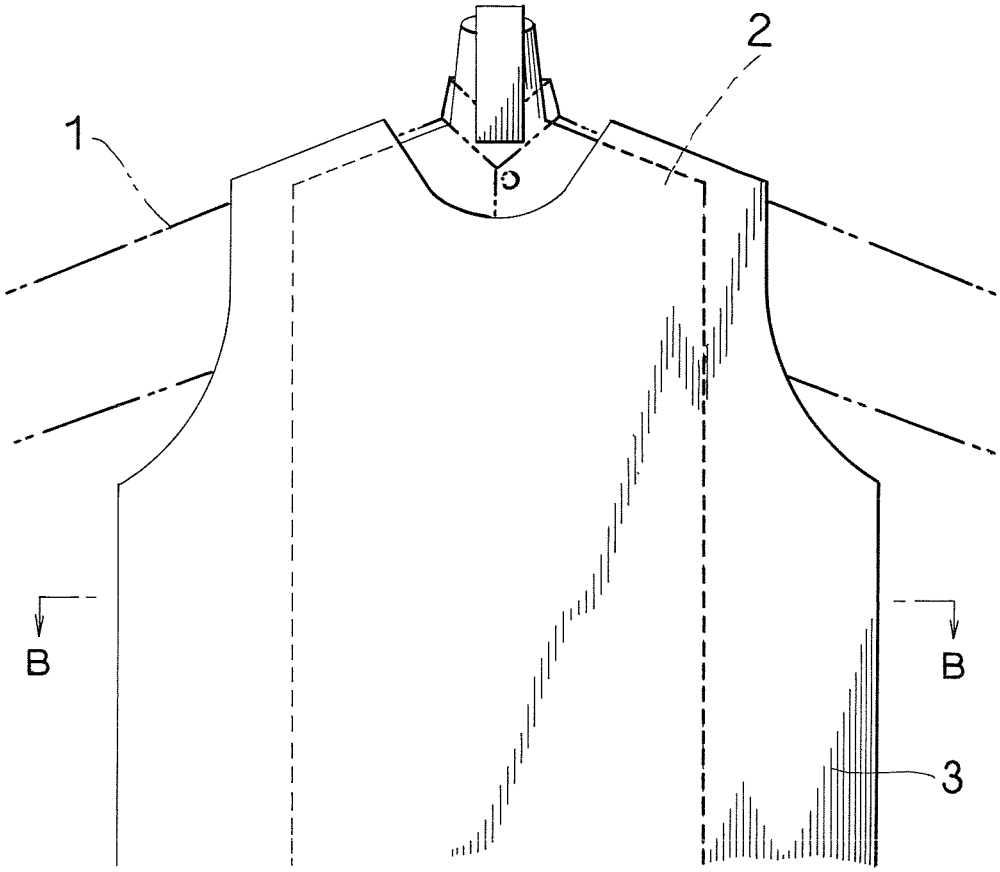
FIG. 1A is essential front view showing a preferable embodiment of the shirts press finishing machine in the present invention.

As shown in FIG. 1, the shirts press finishing machine of this invention comprises a torso 2 for receiving shirt 1, a front part side press iron 3 and a rear part side press iron 4 for pressing the front and rear parts of the torso 2 to perform a press finishing of the shirts 1.

The torso 2 is shaped to imitate the trunk of a human body.

Figure 1B:
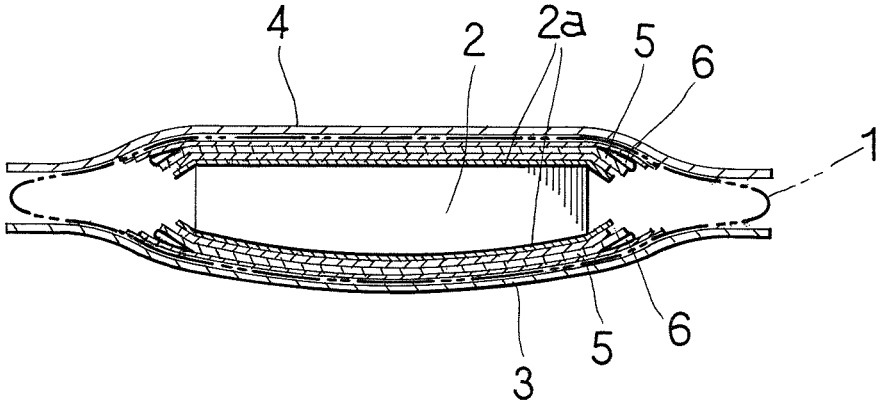
FIG. 1B is a cross sectional view showing the B-B line in FIG. 1A.
Figure 2:
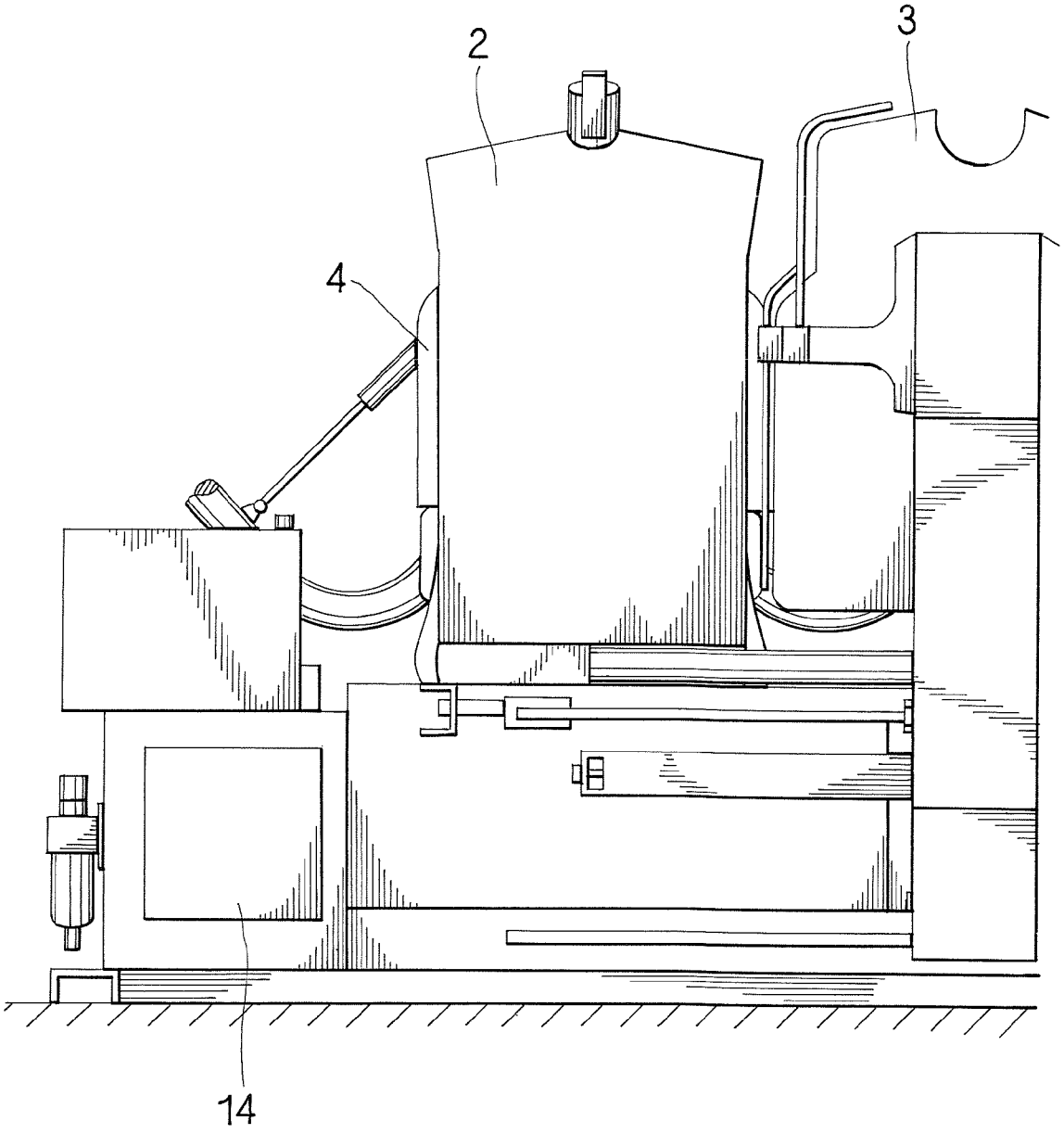
FIG. 2 is an essential front view showing the shirt press finishing machine in the present invention.

In the case of this preferred embodiment, as shown in FIG. 2, the front part side press iron 3 is arranged at the side of the torso 2 and is mounted in such a way that it can be slid in a lateral direction to be positioned at the front of the torso 2 when the shirt 1 is pressed. Further, the rear part side press iron 4 is fixedly arranged at the rear of the torso 2. In addition, as shown in FIG. 1B and FIG. 3, each of the iron surfaces of the press irons 3, 4 are curved inwardly at their positions corresponding to both side parts of the torso 2 and each of the iron surfaces of the press irons 3, 4 is formed to become parallel to each other as they approach the right and left extremity ends of the press irons.

Figure 3:
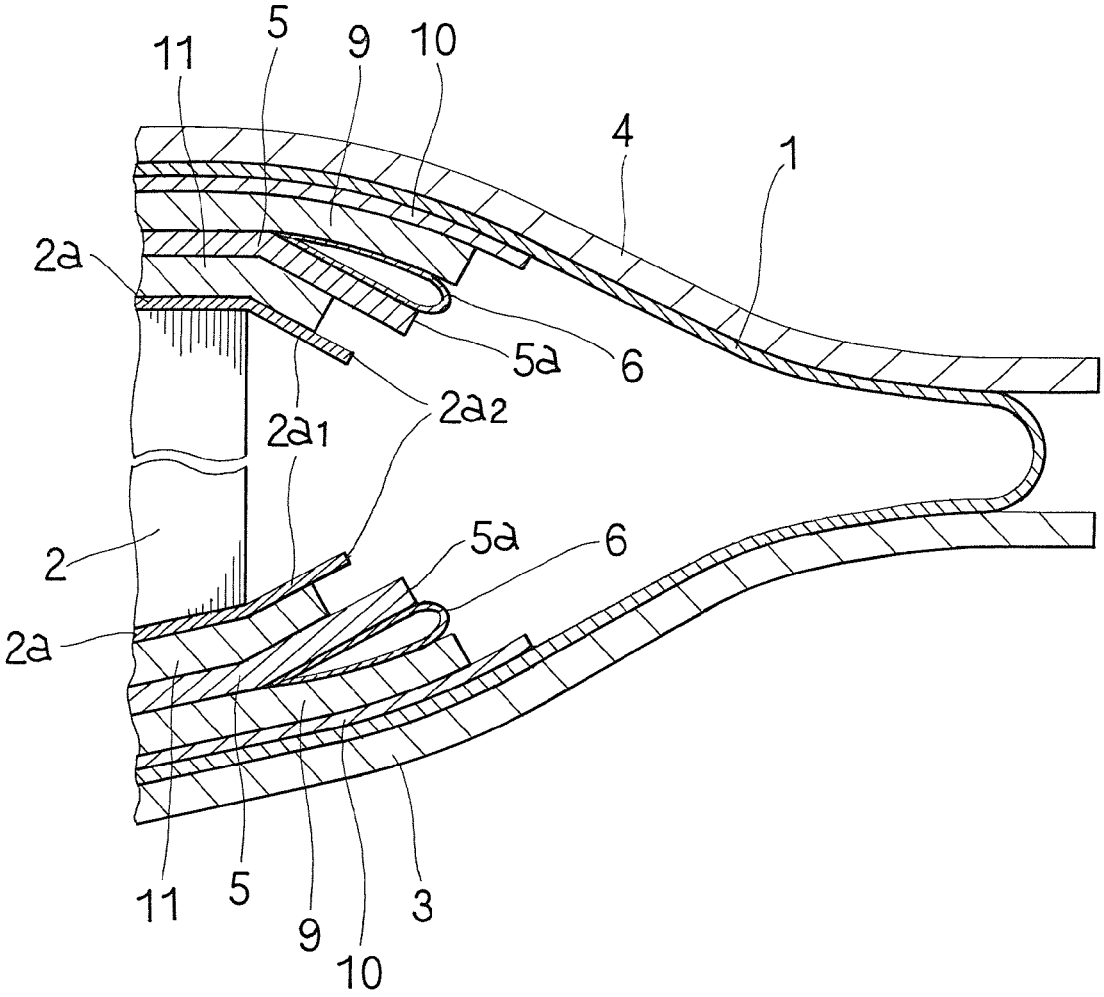
FIG. 3 is an essential enlarged sectional view showing in FIG. B.

Additionally, as shown in FIGS. 1B and 3, this invention is made such that iron receiving surfaces 2*a* of the front and rear parts of the torso 2 are covered with cushion-type sheet materials 5. The sheet materials 5 in this preferred embodiment are formed into felt state of polyester.

Figure 4:
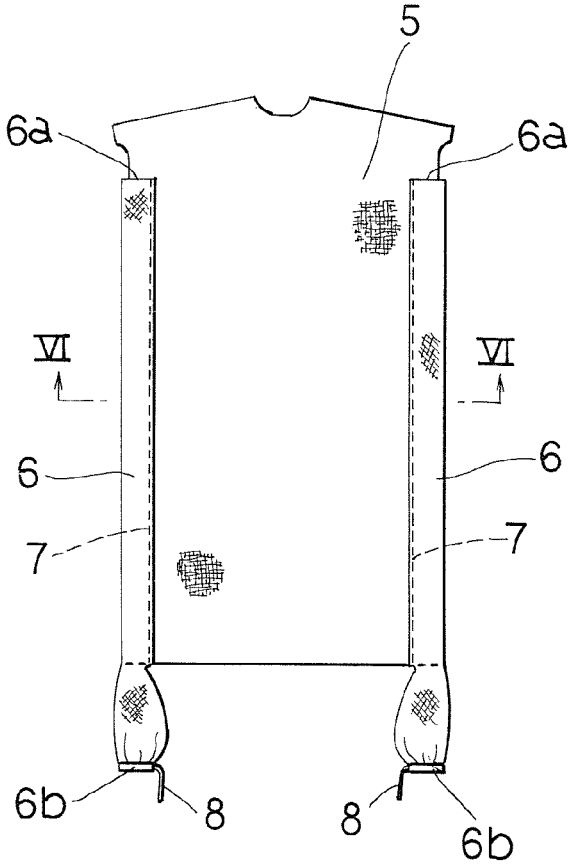
FIG. 4 is a front view showing sheet material.
Figure 5:
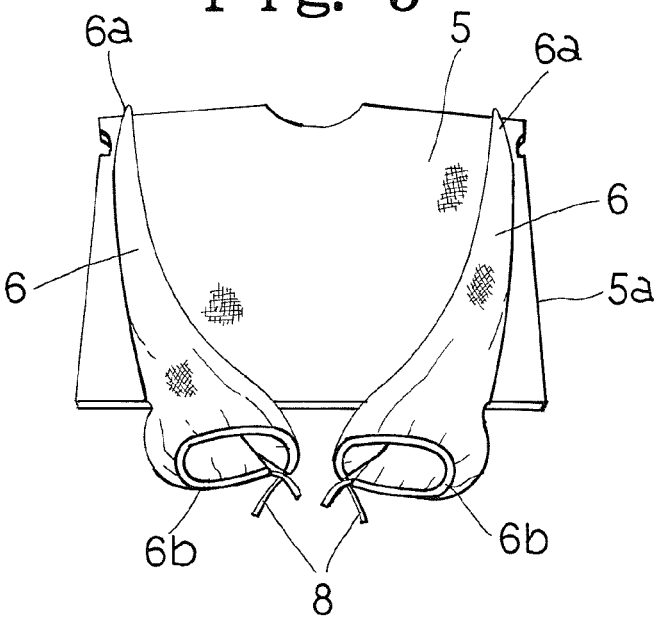
FIG. 5 is a perspective view showing sheet material.
Figure 6:
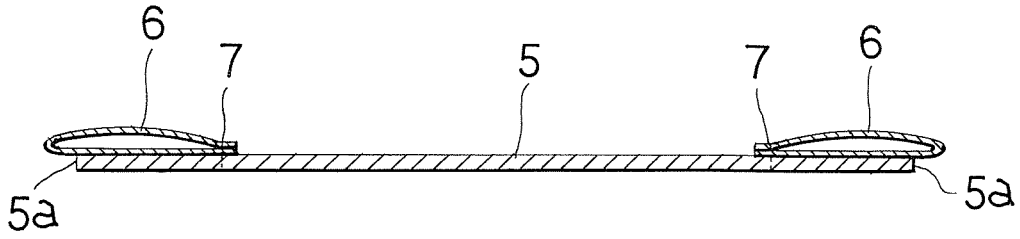
FIG. 6 is an enlarged sectional view showing the VI-VI line in FIG. 4.

Then, this invention, is made such that long and thin bags 6 expanded by supplying gas are attached to both side portions of the front and rear parts sheet materials 5 over substantially the entire longitudinal length of the sheet materials 5, as shown in FIG. 4 to FIG. 6 and other Figures. As shown in FIG. 3 and other Figures, both sections 2*al* of the iron receiving surfaces 2*a* corresponding to the bags 6 are slanted inwardly of the torso 2. With such an arrangement as above, the expanded bags 6 press the shirts 1 to conform firmly to the curved iron surfaces of the press irons 3, 4. Further, the iron receiving surfaces 2*a* are made of plates that are set upright and define a space formed by a front plate and a rear plate.

In addition, the bags 6 in this preferred embodiment are formed from a non-porous cloth. As shown in FIG. 6 and other Figures, the bags 6 are overlapped by both surfaces of side portions of the sheet materials 5 and sewed to both side portions of the sheet materials 5. Accordingly, in this case, it is possible to restrict the bags 6 from contacting the edges 2*a*2 of the iron receiving surfaces 2*a* and damaged therewith as compared with the case in which the bags 6 protrude from and are connected to both side portions of the sheet materials 5.

Figure 7:
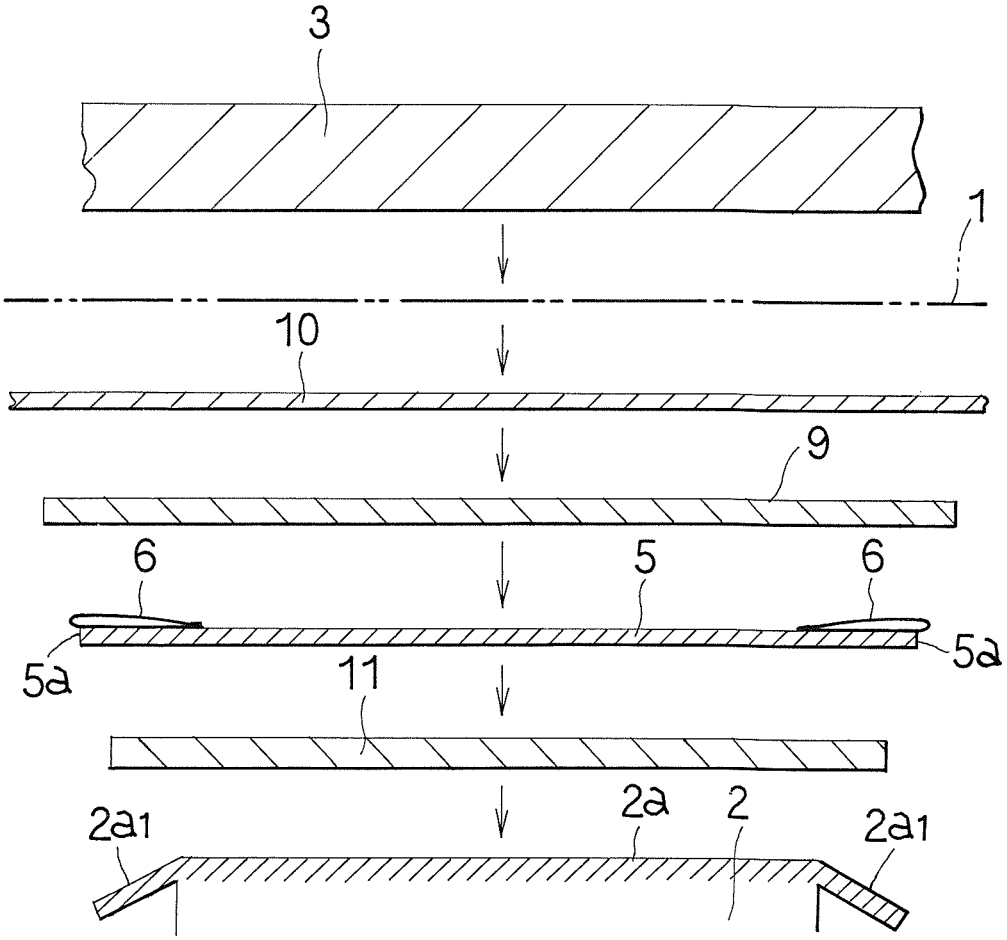
FIG. 7 is an essential disassembled sectional view show ing the shirts press finishing machine in the present invention.

Reference numeral 7 denotes a seam. The upper ends 6*a* of the bags 6 are closed. In addition, the lower ends 6*b* protrude from the lower edges of the sheet materials 5 are opened and form inlet ports for gas. The lower ends 6*b* of the bags 6 are folded back and double sewed and then fastening strings 8 are passed through it. As shown in FIG. 3 and FIG. 7, this invention in the preferred embodiment is made such that another cushion-type sheet materials 9 are overlapped with the sheet materials 5. In this case, the other sheet materials 9 protrude out of both edges 5*a* of the sheet materials 5. Accordingly, with this arrangement, when the bags 6 are expanded, it is possible to press the shirts 1 against the iron surfaces of the press irons 3, 4 through the other sheet materials 9, and it is also possible to prevent the lines at both ends 2*a*2 of the iron receiving surface 2*a* from applying iron marks to the side parts of the shirts 1 with the other sheet materials 9.

In addition, the other sheet materials 9 are covered with covers 10. Further, the other sheet materials 9 in this preferred embodiment are formed by the same material as that of the sheet materials 5.

Additionally, this invention in the preferred embodiment is made such that resilient mats 11 of silicone are held between the iron receiving surface 2*a* and the sheet material 5. In this case, the mats 11 are arranged so as not to protrude out of the edges 2*a*2 of the iron receiving surface 2*a*.

Further, both edges 5*a* of the sheet materials 5 protrude out of both edges 2*a*2 of the iron receiving surfaces 2*a*. Accordingly, in this case, when a press pressure is applied to the sheet materials 5, the sheet materials 5 cover both edges 2*a*2 of the iron receiving surfaces 2*a*. Thus, with this arrangement, it is possible more positively to prevent the lines at both ends of the iron receiving surfaces 2*a* from being applied to the side parts of the shirts 1 as the iron marks together with the bags 6.

Figure 8:
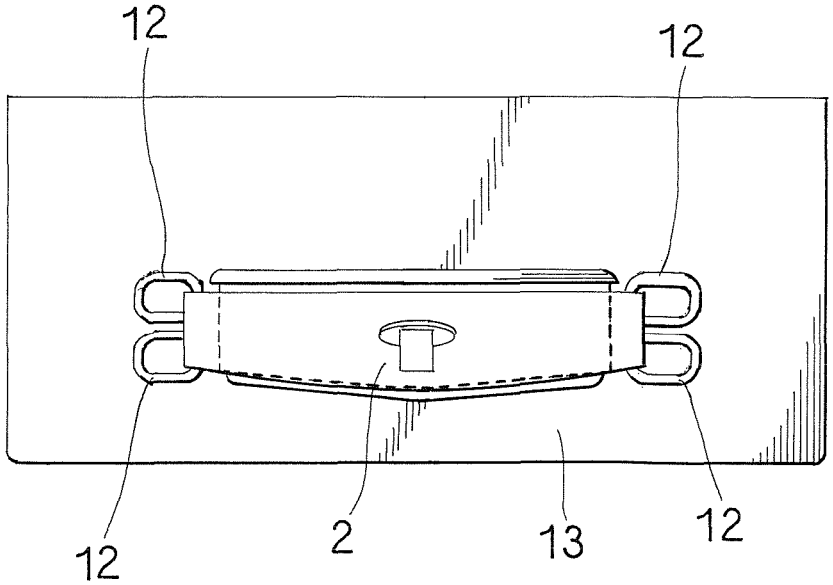
FIG. 8 is an essential flat view showing the shirts press finishing machine in the present invention.
Figure 9:
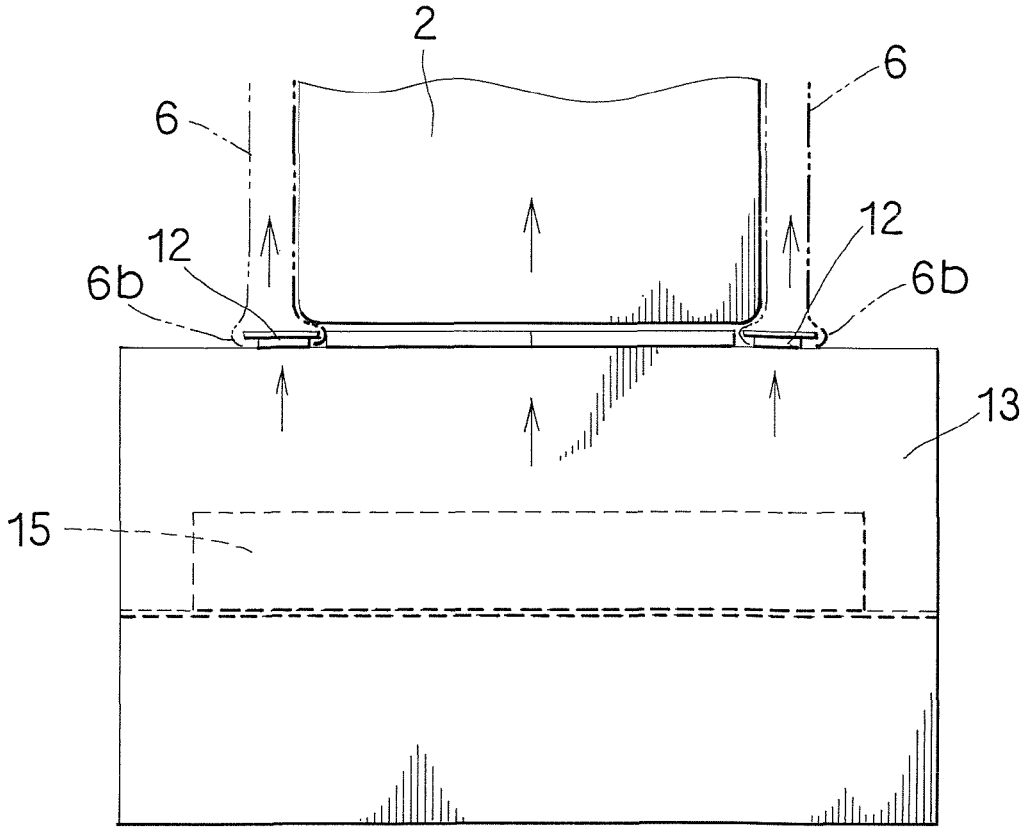
FIG. 9 is an essential front view showing the shirts press finishing machine in the present invention.

Additionally, as shown in FIG. 8 and FIG. 9, the bags 6 are set such that their ends 6*b* are applied to cover the duct-like fixing portions 12 and they are attached to them by utilization of the fastening strings S. The fixing portions 12 are arranged in their upright state at the upper surface of a base part 13 in corresponding to the four corners of the torso 2.

This invention in the preferred embodiment is formed such that the hot air acting as gas can be supplied to the bags 6 from within the base part 13 through the fixing portions 12. That is, the air sent from a blower 14 (refer to FIG. 2) is sent into the base part 13, heated by a heater 15 (refer to FIG. 9) and changed into hot air. Then, the hot air is sent into the torso 2 and at the same time, the hot air is sent to each of the bags 6 through the fixing portions 12, thereby each of the bags 6 is expanded. Accordingly, in the case of this invention of the preferred embodiment, the bags 6 can be expanded efficiently with a simple structure through utilization of the hot air supplied into the torso 2 so as to dry the shirts.

Figure 10:
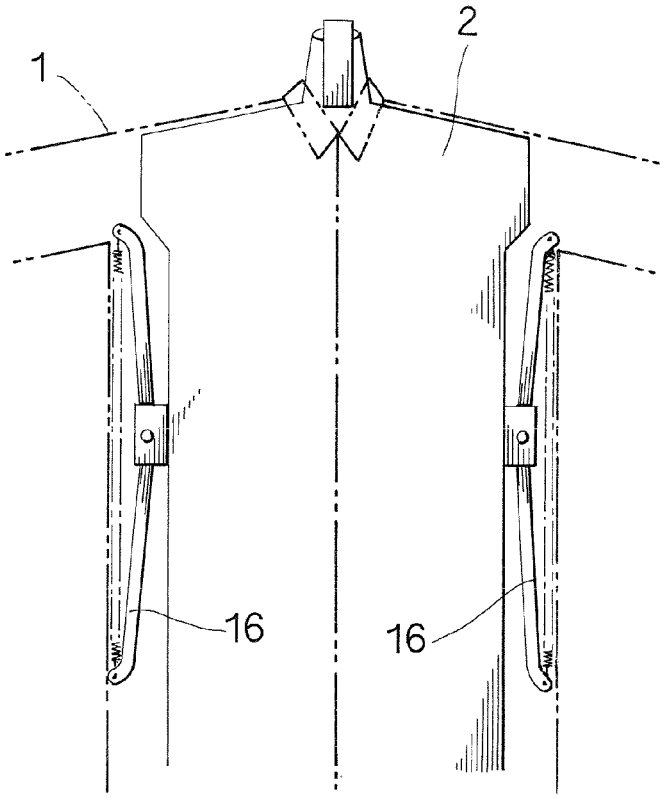

In addition, as shown in FIG. 10, the shirt press finishing machine of this invention in the preferred embodiment is set such that the devices 16 for expanding the side parts of the shirts 1 are arranged at both side parts of the torso 2. The side parts of the shirts 1 are expanded sideways with the devices 16 and at the same time some wrinkles are removed with the hot air flowing out of the iron surfaces of the press irons 3, 4 and within the torso 2 so as to attain the drying and press finishing operations.

Then, the actions of the shirts press finishing machine of this invention and the sheet material will be described as follows.

Figure 11:
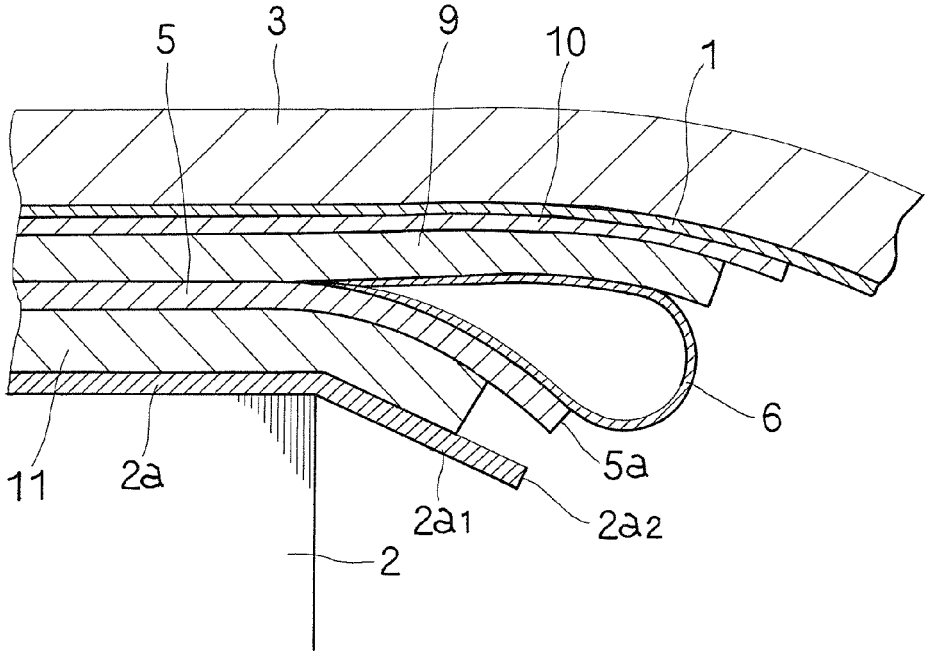
FIG. 11 is an essential enlarged sectional view explaining the action of the shirts press finishing machine.

In this invention, As shown in FIG. 11, when the bags 6 are expanded, the bags 6 to press the side parts of the shirts 1 to the iron surfaces of the press irons 3, 4 through another sheet materials 9 and the cover 10.

Accordingly, positions of the shirts 1 correspond to the side parts of the torso 2 are softly press finished with the press irons 3, 4. As a result, in accordance with this invention, the shirts 1 can be finished neatly without applying iron marks by the lines at both ends of the torso 2 to the side parts of the shirts 1.

Additionally, the shirts press finishing machine of this invention in its preferred embodiment is constructed as described above in such a way that the iron receiving surfaces 2*a*, the sheet materials 5, another sheet materials 9 and the covers 10 are protruded sideways in sequence and overlapped with each other as the members are set outwardly of the shins press finishing machine. Then, both sections 2*a*1 of the iron receiving surface 2*a* are slanted inwardly.

Accordingly, as the press irons 3, 4 press the shirts 1, the side parts of the shirts 1 are pressed against the sections 2*al* at both sides of the iron receiving surface 2*a* corresponding to the iron surfaces of the press irons 3, 4. As a result, since this invention enables the side parts of the shirts 1 to be positively and accurately pressed with the press irons 3, 4 at both side parts of the torso 2, in view of this fact, the shirts 1 can be finished neatly.

In the foregoing arrangement, although the aforesaid example shows that the mat 11 is held between the iron receiving surfaces 2*a* and the sheet materials 5 and the iron receiving surfaces 2*a* are covered with the sheet materials 5 through the mat 11, this invention is not restricted to such an arrangement as described above. That is, this invention may also be applicable to a system formed in such a way that the press pressure can be received only with the sheet material 5 in place of material quality and a thickness of the sheet material 5.

In addition, this invention may also be applicable to another system in which another sheet material 9 is eliminated. Additionally, it may also be applicable for this invention to provide a system in which another sheet materials 9 are overlapped with the iron receiving surface 2*a* in advance and the sheet materials 5 are overlapped with the bags 6 being placed inside.

Additionally, in the case of the aforesaid example, although the bags 6 are formed by folding non-porous cloth into two segments and sewed at their released ends to the sheet materials 5, a method for forming the bags 6 is not restricted to this process. Farther, it may also be applicable that the center of the bags 6 in a lateral width direction is sewed to the sheet materials 5, and also for example, the bags can be removed and attached to the sheet materials 5 by a zipper. It may also be applicable that the bags 6 are arranged at the side ends of the sheet materials 5 while being protrude out for extend side parts.

In addition, although the shirts press finishing machine is formed to be sent the hot air acting as gas separately from the fixing portions 12 to each of the bags 6, this invention is not restricted to this embodiment. That is, the shirts press finishing machine of this invention may also be applicable as a system in which the lower ends 6*b* of the bags 6 are connected to and communicated to each other to form one assembly unit and connected at one fixing portion 12.

The invention claimed is:

1. A shirt press finishing machine comprising a torso on which the shirts are put, and a pair of a front part side press iron and a rear part side press iron for use in press finishing of the shirt while pressing the front and rear parts of the torso, wherein iron receiving surfaces of the front and rear parts of the torso are covered with cushioning sheet materials; and long and thin bags expanded by supplying gas are attached between an end portion of each of the front and rear parts sheet materials over substantially the entire longitudinal length of the sheet materials;

wherein an edge of each section of the iron receiving surfaces corresponding to the bags are slanted inwardly of the torso, by an angle such that the edges of both sections of the iron receiving surfaces do not come in contact with one another;

the edge surfaces of both bags are overlapped by the side portions of the sheet material;

the cushioning sheet material protrudes laterally out of both edges of the iron receiving surface;

other cushioning sheet material protrudes out of both edges of the sheet material and overlaps the sheet material; and, each bag is positioned between the side parts of the sheet material and the other sheet material; and wherein the bags are positioned laterally inward from the outer edges of the front and rear side press irons;

whereby the expanded bags are positioned to prevent contact with and damage by the edges of the iron receiving surfaces, and the edge lines of the edges of the iron receiving surfaces are positioned to prevent contacting and applying iron marks to the side parts of the shirt.

2. The shirt press finishing machine according to claim 1, wherein the lower ends of the bags are opened and define a plurality of inlet ports for gas, duct fixing portions for attaching the inlet ports of the bags arranged at the upper surface of a base part corresponding to the fixing portions and defining the plurality of inlet ports and the gas is supplied to the bags from within the base part through the fixing portions.

3. A cushioning sheet material covering iron receiving surfaces of the front and rear parts of the torso in combination with a shirt press finishing machine according to claim 1, wherein the long and thin bags expanded by supplying gas are attached to both side portions of the front and rear parts sheet materials over substantially the entire longitudinal length of the sheet materials; and, wherein the overlapped bags are attached to both sides of the sheet materials.

* * * * *